US011691195B2

(12) United States Patent
Anderson et al.

(10) Patent No.: US 11,691,195 B2
(45) Date of Patent: Jul. 4, 2023

(54) SYSTEM, APPARATUS, AND METHOD FOR A DIRECT CHILL CASTING COOLING WATER SPRAY PATTERN

(71) Applicant: WAGSTAFF, INC., Spokane Valley, WA (US)

(72) Inventors: Michael K. Anderson, Otis Orchards, WA (US); David A. Salee, Spokane, WA (US)

(73) Assignee: WAGSTAFF, INC., Spokane Valley, WA (US)

( * ) Notice: Subject to any disclaimer, the term of this patent is extended or adjusted under 35 U.S.C. 154(b) by 0 days.

(21) Appl. No.: 17/305,362

(22) Filed: Jul. 6, 2021

(65) Prior Publication Data

US 2022/0008987 A1 Jan. 13, 2022

Related U.S. Application Data

(60) Provisional application No. 63/050,391, filed on Jul. 10, 2020.

(51) Int. Cl.
*B22D 11/049* (2006.01)
*B22D 11/124* (2006.01)

(52) U.S. Cl.
CPC ..... *B22D 11/049* (2013.01); *B22D 11/1246* (2013.01)

(58) Field of Classification Search
CPC . B22D 11/049; B22D 11/055; B22D 11/1246; B22D 11/1248
See application file for complete search history.

(56) References Cited

U.S. PATENT DOCUMENTS

| | | | | |
|---|---|---|---|---|
| 2,424,640 A * | 7/1947 | Spooner | B22D 11/124 164/443 |
| 2,515,284 A * | 7/1950 | St John | B22D 11/049 164/487 |
| 5,390,725 A * | 2/1995 | Berclaz | B22D 11/049 164/487 |
| 5,582,230 A | 12/1996 | Wagstaff et al. | |
| 2012/0241118 A1 | 9/2012 | Wagstaff et al. | |
| 2020/0122227 A1 | 4/2020 | Kitahara et al. | |

FOREIGN PATENT DOCUMENTS

EP 1195210 A2 4/2002

OTHER PUBLICATIONS

International Search Report and Written Opinion for PCT/US2021/040038 (ISA/EP) dated Sep. 10, 2021 (14 pages).

* cited by examiner

*Primary Examiner* — Kevin E Yoon
*Assistant Examiner* — Jacky Yuen
(74) *Attorney, Agent, or Firm* — Alston & Bird LLP

(57) ABSTRACT

The present disclosure relates to a system, apparatus, and method for a cooling water spray pattern for a direct chill casting mold, and more particularly, to a spiral water spray pattern for a direct chill billet casting mold. An example direct chill casting mold includes a mold body defining a mold cavity there through; and a plurality of spray jets arranged proximate an exit of the mold cavity, wherein the plurality of spray jets are angled with respect to the mold cavity such that streams of fluid exiting the plurality of spray jets impinge upon a casting exiting the mold cavity at an angle offset from a centerline of the casting.

18 Claims, 12 Drawing Sheets

SYSTEM, APPARATUS, AND METHOD FOR A DIRECT CHILL CASTING COOLING WATER SPRAY PATTERN

CROSS-REFERENCE TO RELATED APPLICATIONS

This application claims priority to U.S. Provisional Patent Application Ser. No. 63/050,391, filed on Jul. 10, 2020, the contents of which are hereby incorporated by reference in their entirety.

TECHNOLOGICAL FIELD

The present disclosure relates to a system, apparatus, and method for a cooling water spray pattern for a direct chill casting mold, and more particularly, to a spiral water spray pattern for a direct chill billet casting mold.

BACKGROUND

Metal products may be formed in a variety of ways; however numerous forming methods first require an ingot, billet, or other cast part that can serve as the raw material from which a metal end product can be manufactured, such as through rolling or machining, for example. One method of manufacturing an ingot or billet is through a continuous casting process known as direct chill casting, whereby a vertically oriented mold cavity is situated above a platform that translates vertically down a casting pit. A starter block may be situated on the platform and form a bottom of the mold cavity, at least initially, to begin the casting process. Molten metal is poured into the mold cavity whereupon the molten metal cools, typically using a cooling fluid. The platform with the starter block thereon may descend into the casting pit at a predefined speed to allow the metal exiting the mold cavity and descending with the starter block to solidify. The platform continues to be lowered as more molten metal enters the mold cavity, and solid metal exits the mold cavity. This continuous casting process allows metal ingots and billets to be formed according to the profile of the mold cavity and having a length limited only by the casting pit depth and the hydraulically actuated platform moving therein.

The direct chill casting process within the aluminum world refers to the process of semi-continuous casting of aluminum ingots or billets thru and open mold in which the bulk of solidification takes place due to the direct application of cooling water upon the initial forming shell. The initial shell is formed by the heat extraction of the physical mold wall itself, while the remaining solidification is controlled by the cooling water. Over the years there have been many variations in the method of applying the cooling water to the product being cast. These range from continuous water curtains, to water spray holes, to water spray nozzles, and others.

BRIEF SUMMARY

The present disclosure relates to a system, apparatus, and method for a cooling water spray pattern for a direct chill casting mold, and more particularly, to a spiral water spray pattern for a direct chill billet casting mold. Embodiments provided herein include a direct chill casting mold including: a mold body defining a mold cavity there through; and a plurality of spray jets arranged proximate an exit of the mold cavity, where the plurality of spray jets are angled with respect to the mold cavity such that streams of fluid exiting the plurality of spray jets impinge upon a casting exiting the mold cavity at an angle offset from a centerline of the casting. The plurality of spray jets are arranged in a radial pattern around the exit of the mold cavity, and where the plurality of spray jets cooperate to provide a spiral of cooling fluid around the casting as it exits the mold cavity. The plurality of spray jets of some embodiments are angled with respect to the mold cavity such that the streams of fluid exiting the plurality of spray jets experience the Coandă effect around a curvature of the casting exiting the mold cavity.

According to some embodiments, the angle offset from the centerline of the casting comprises a perpendicular rotated angle relative to the casting. The perpendicular rotated angle includes a vertical angle of between about 35 to 45 degrees from perpendicular to the casting. According to some embodiments, the perpendicular rotated angle includes a horizontal angle of between about 20 and 45 degrees from the centerline of the casting. The plurality of spray jets of some embodiments includes a first plurality of spray jets arranged at a first perpendicular rotated angle relative to the casting, the direct chill casting mold further including a second plurality of spray jets, where the second plurality of spray jets are arranged at a second perpendicular angle relative to the casting different than the first perpendicular rotated angle of the first plurality of spray jets. The second perpendicular rotated angle relative to the casting includes a horizontal angle equivalent to the horizontal angle of the first perpendicular rotated angle and a vertical angle different from the first perpendicular rotated angle. The angle offset from a centerline of the casting of some embodiments is less than an angle resulting in a stream of fluid tangential to the casting.

Embodiments provided herein include a method for direct chill casting including: casting a billet from a direct chill casting mold cavity of a direct chill casting mold having a plurality of spray jets; and directing a cooling fluid from the plurality of spray jets to impinge upon the casting exiting the mold cavity at an angle offset from a centerline of the casting. The plurality of spray jets of some embodiments are arranged in a radial pattern around an exit of the mold body, where the plurality of spray jets cooperate to provide a spiral of cooling fluid around the casting as it exits the mold cavity. The plurality of spray jets of some embodiments are angled with respect to the mold cavity such that the streams of fluid exiting the spray jets experience the Coandă effect around a curvature of the casting exiting the mold cavity.

According to some embodiments, the angle offset from the centerline of the casting includes a perpendicular rotated angle relative to the casting. The perpendicular rotated angle includes a vertical angle of between about 35 to 45 degrees from perpendicular to the casting. The perpendicular rotated angle of some embodiments includes a horizontal angle of between about 20 and 45 degrees from the centerline of the casting. The plurality of spray jets includes a first plurality of spray jets arranged at a first perpendicular rotated angle relative to the casting, the direct chill casting mold body further including a second plurality of spray jets, wherein the second plurality of spray jets are arranged at a second perpendicular rotated angle relative to the casting different than the first perpendicular rotated angle of the first plurality of spray jets. According to some embodiments, the second perpendicular rotated angle relative to the casting comprises a horizontal angle equivalent to the horizontal angle of the first perpendicular rotated angle and a vertical angle different from the first perpendicular rotated angle. The angle offset from a centerline of the casting of some embodiments is less than an angle resulting in a stream of fluid tangential to the casting.

BRIEF DESCRIPTION OF THE DRAWINGS

Figure 1:
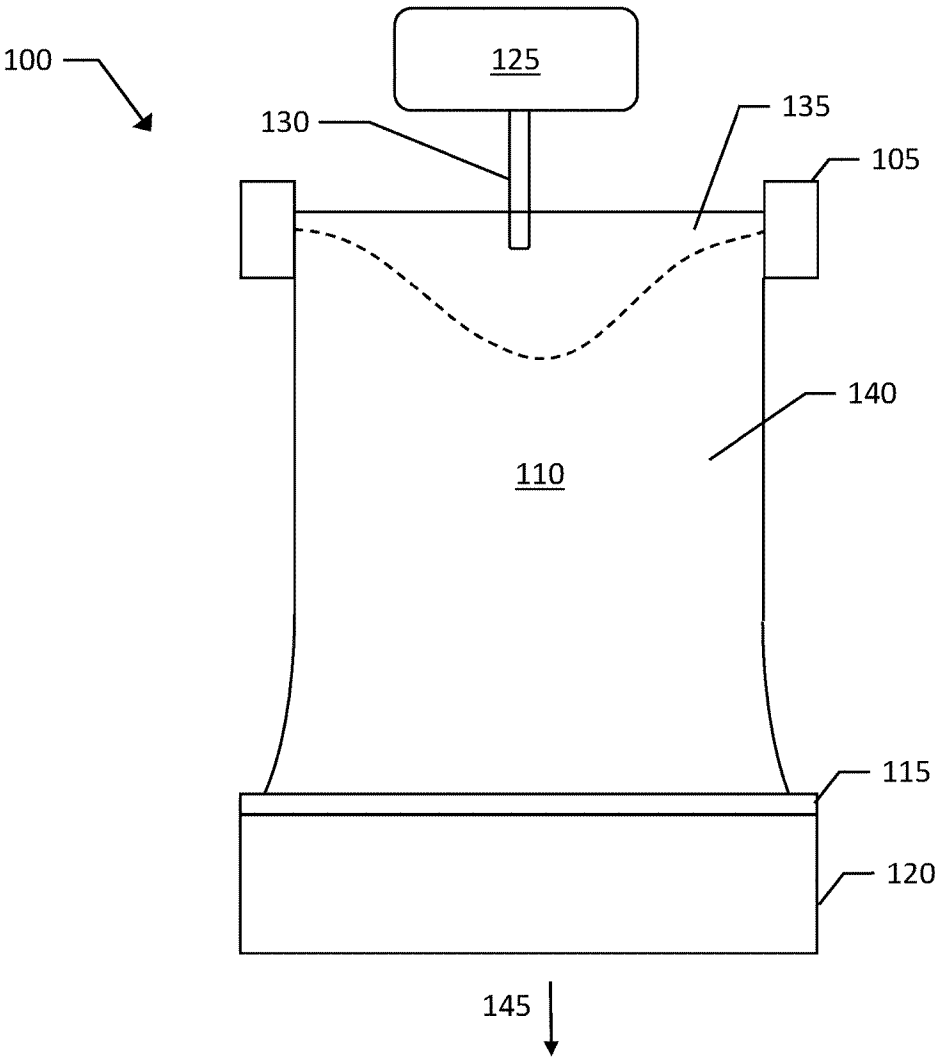
FIG. 1 (PRIOR ART)
Figure 2:
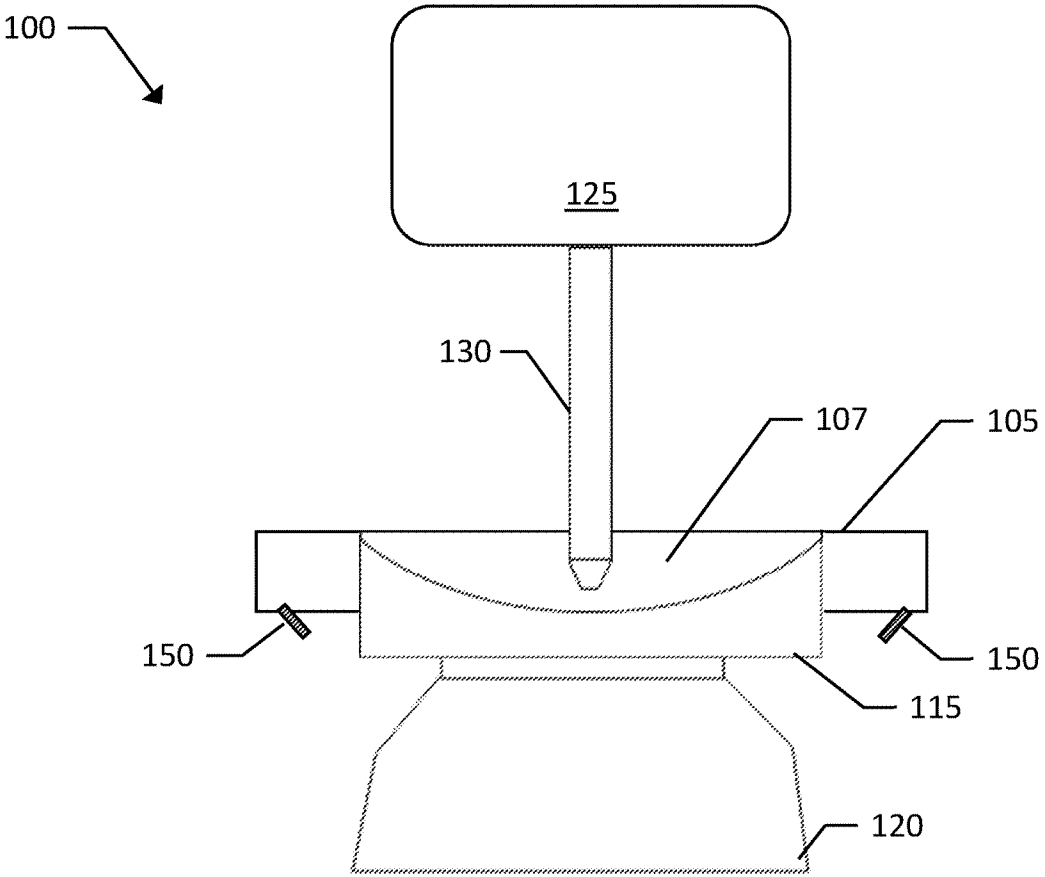
Figure 3:
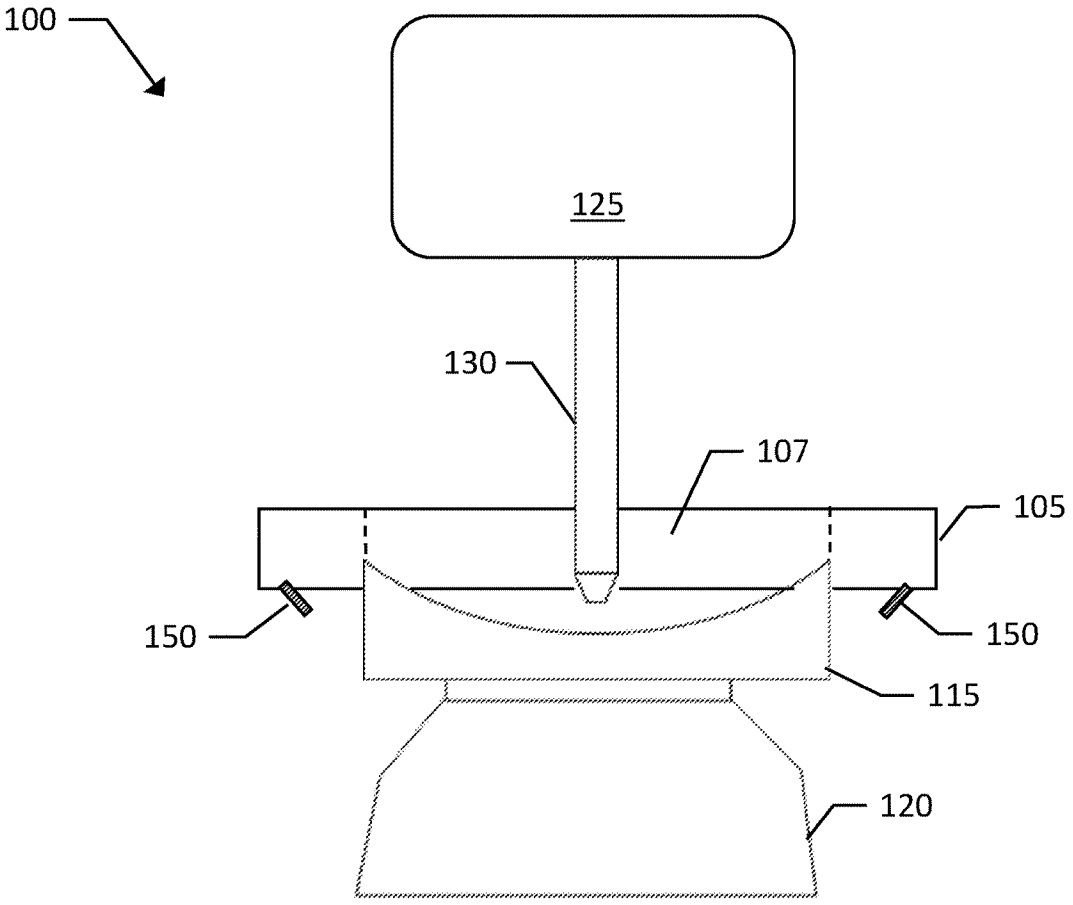
Figure 4:
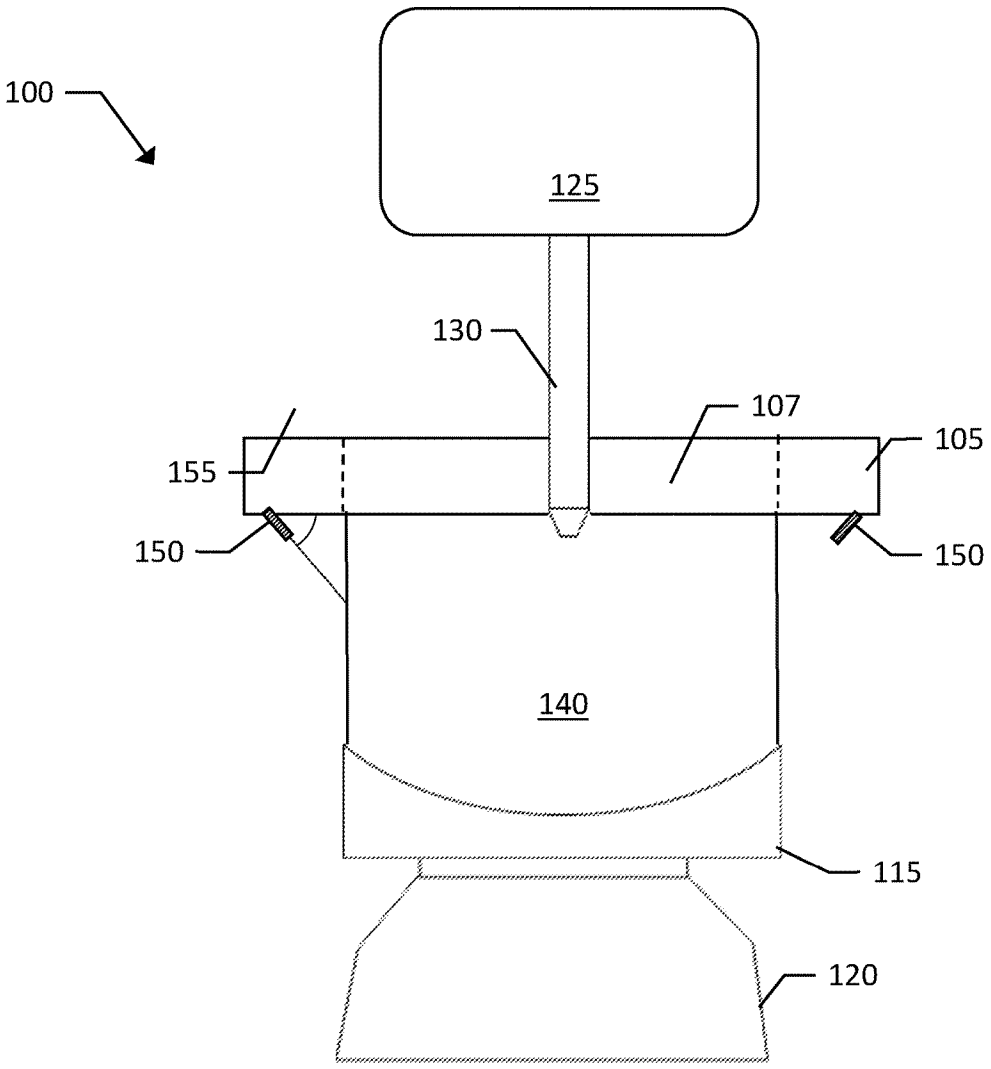
Figure 6B:
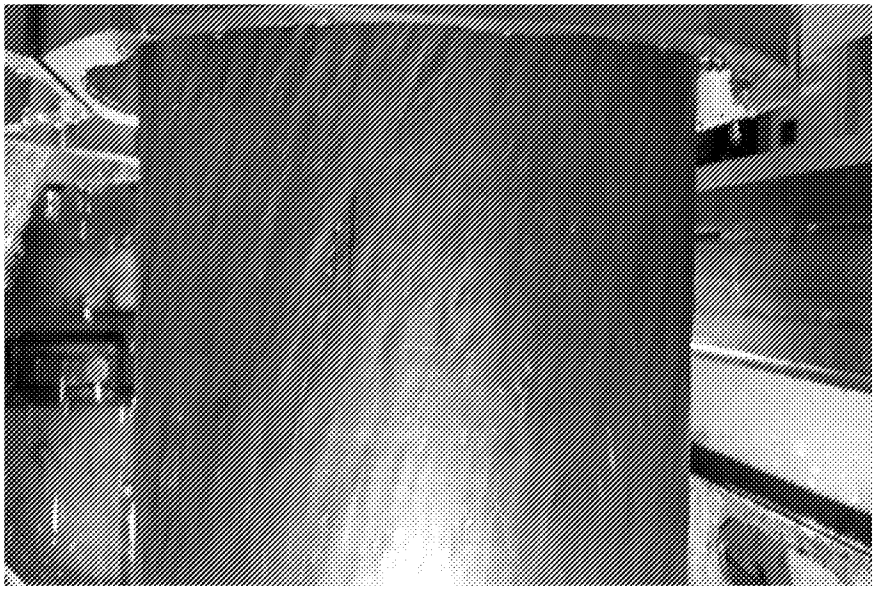
Figure 6A:
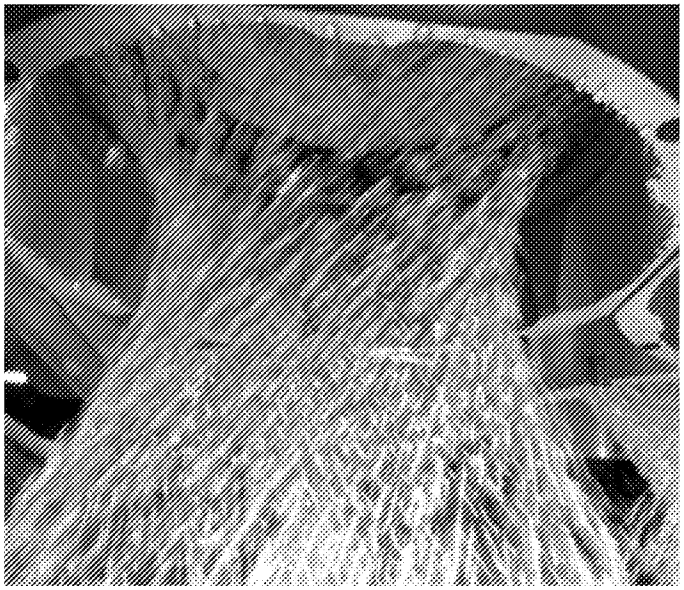
Figure 6D:
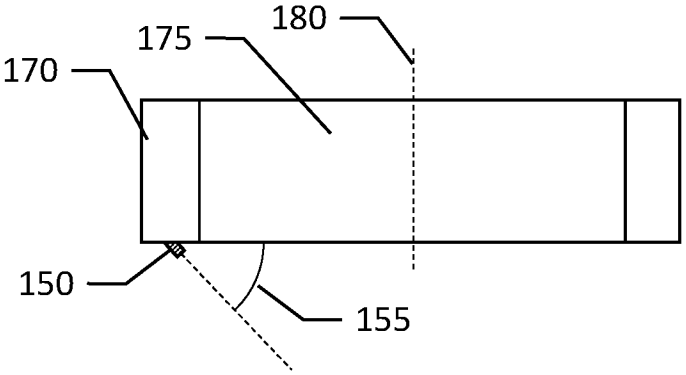
Figure 6C:
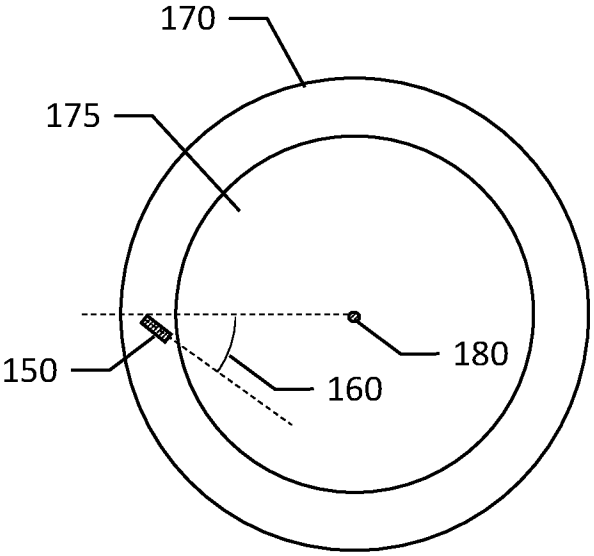
Figure 7:
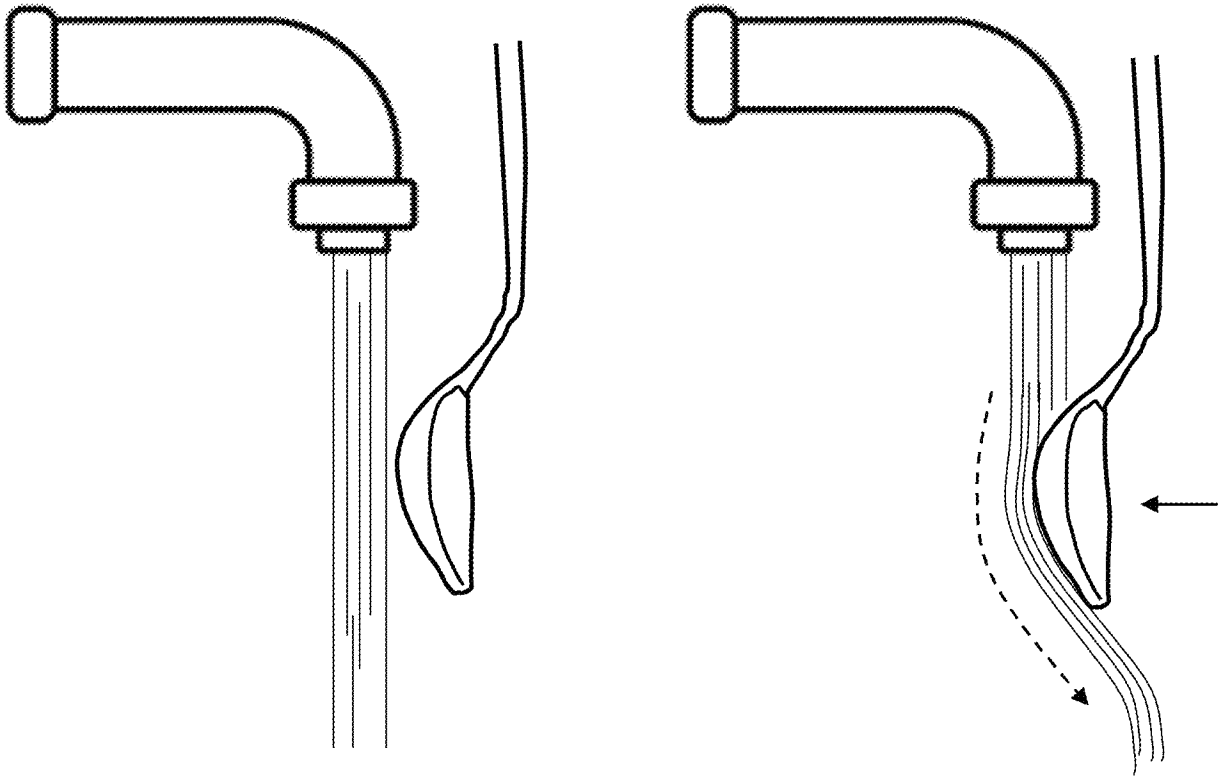
Figure 8:
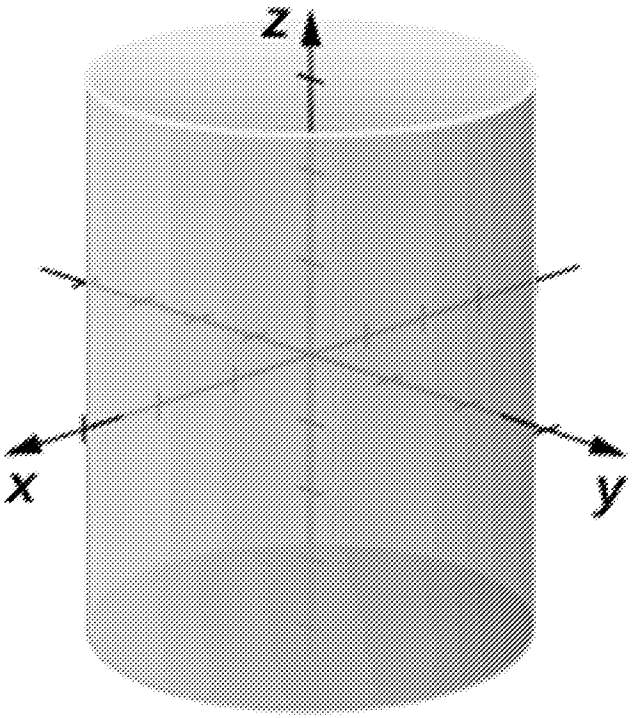
Figure 9B:
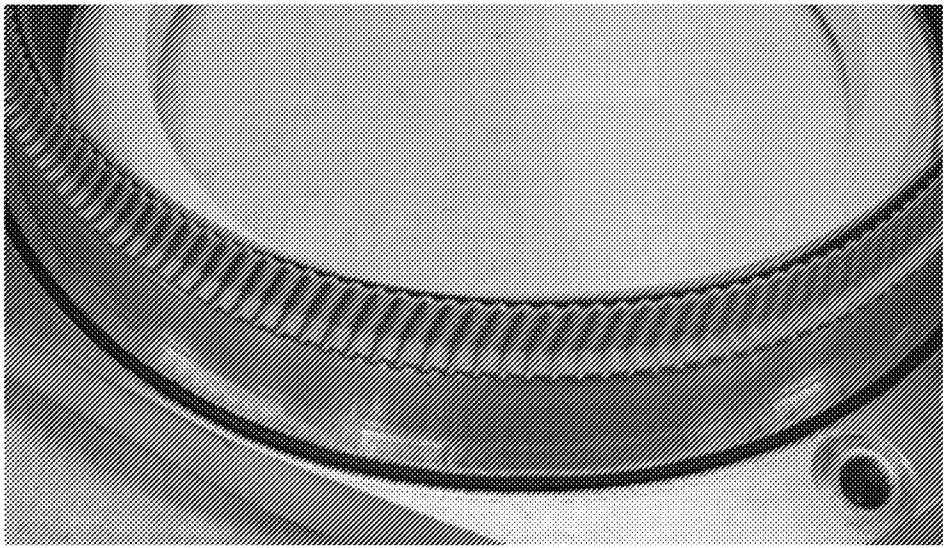
Figure 9A:
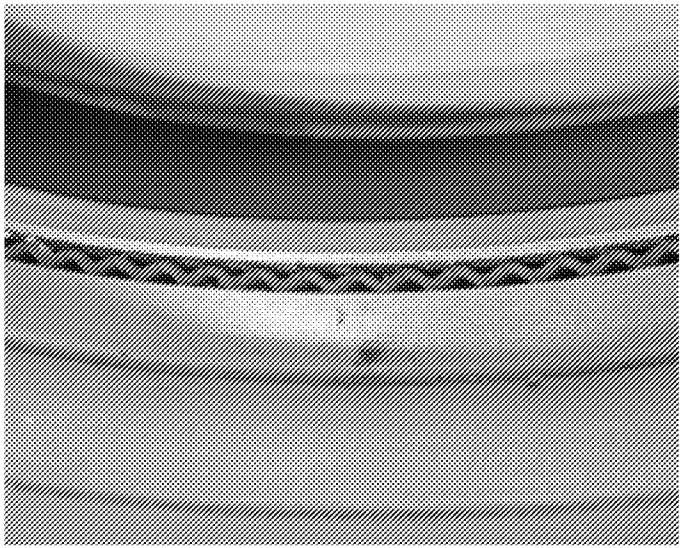
Figure 10B:
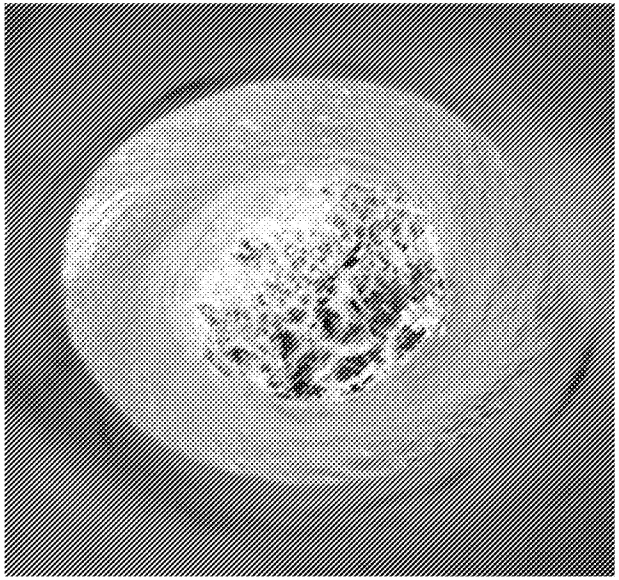
Figure 10A:
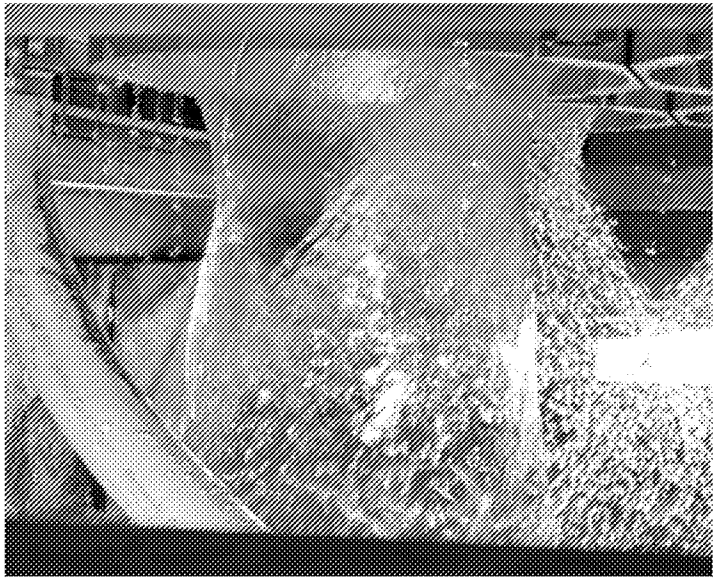
Figure 11C:
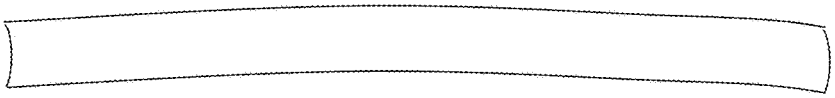
Figure 11B:
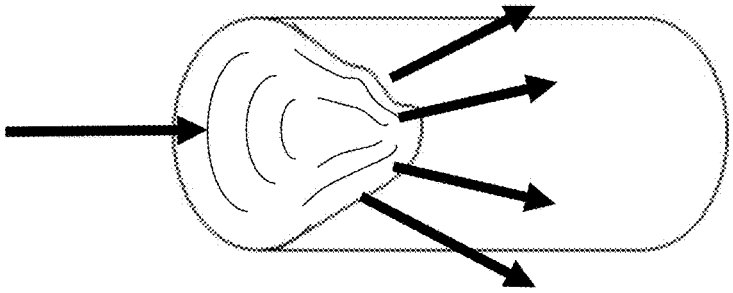
Figure 11A:
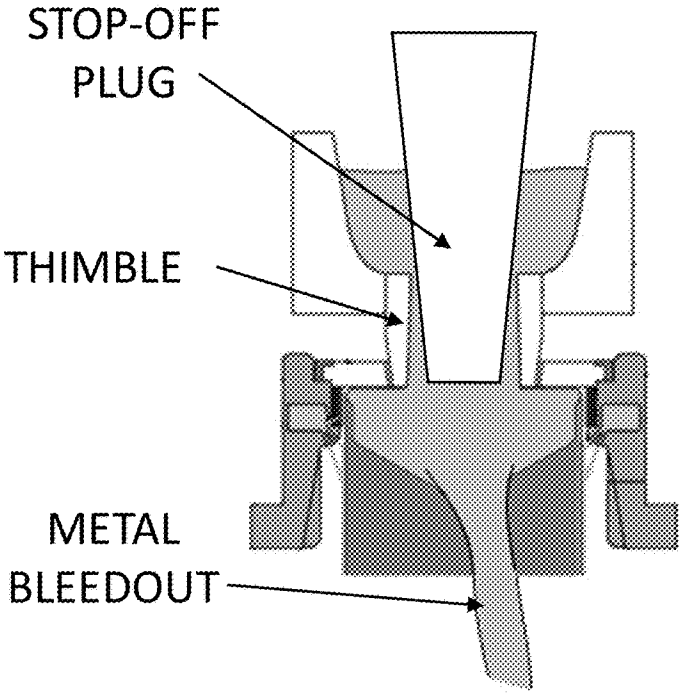

Having thus described the invention in general terms, reference will now be made to the accompanying drawings, which are not necessarily drawn to scale, and wherein:

FIG. 1 illustrates an example embodiment of a direct chill casting mold according to the prior art;

FIG. 2 illustrates an example of the initial stages of direct chill casting or continuous casting according to an example embodiment of the present disclosure;

FIG. 3 illustrates an example embodiment following the initial stages of direct chill casting according to an example embodiment of the present disclosure;

FIG. 4 illustrates an example embodiment of steady-state direct chill casting according to an example embodiment of the present disclosure;

FIGS. 5A-5D illustrate conventional issues in billets produced by a direct chill casting system according to an example embodiment of the present disclosure;

FIGS. 6A-6B illustrate a spiral cooling fluid pattern according to an example embodiment of the present disclosure;

FIGS. 6C-6D illustrate a simplified diagram of a direct chill casting billet mold having a representative spray jet and the angles associated therewith according to an example embodiment of the present disclosure;

FIG. 7 illustrates the Coandă effect according to an example embodiment of the present disclosure;

FIG. 8 illustrates axes of a billed of a direct chill casting system according to an example embodiment of the present disclosure;

FIGS. 9A-9B illustrate a corrugated ring for producing a spiral pattern cooling fluid according to an example embodiment of the present disclosure;

FIGS. 10A-10B illustrate a spiral pattern cooling fluid according to an example embodiment of the present disclosure; and FIGS. 11A-11C illustrate a direct casting defect known as a bleed-out and a resulting issue for adjacent castings according to an example embodiment of the present disclosure.

DETAILED DESCRIPTION

Example embodiments of the present disclosure now will be described more fully hereinafter with reference to the accompanying drawings, in which some, but not all embodiments of the disclosure are shown. Indeed, embodiments may take many different forms and should not be construed as limited to the embodiments set forth herein; rather, these embodiments are provided so that this disclosure will satisfy applicable legal requirements. Like numbers refer to like elements throughout.

Embodiments of the present disclosure generally relate to a system, apparatus, and method for cooling a billet from a direct chill casting mold, and specifically, to a spiral pattern of cooling fluid used to envelop the billet exiting the casting mold to cool the billet as it descends into the casting pit.

Vertical direct chill casting or continuous casting is a process used to produce ingots or billets that may have a variety of cross-sections shapes and sizes for use in a variety of manufacturing applications. The process of direct chill casting begins with a horizontal mold table or mold frame containing one or more vertically-oriented molds disposed therein. Each of the molds defines a mold cavity, where the mold cavities are initially closed at the bottom with a starter block to seal the bottom of the mold cavity. Molten metal is introduced to each mold cavity through a metal distribution system to fill the mold cavities. As the molten metal proximate the bottom of the mold, adjacent to the starter block solidifies, the starter block is moved vertically downward along a linear path into a casting pit. The movement of the starter block may be caused by a hydraulically-lowered platform to which the starter block is attached. The movement of the starter block vertically downward draws the solidified metal from the mold cavity while additional molten metal is introduced into the mold cavities. Once started, this process moves at a relatively steady-state for a continuous casting process that forms a metal ingot having a profile defined by the mold cavity, and a height defined by the depth to which the platform and starter block are moved.

During the casting process, the mold itself is cooled to encourage solidification of the metal prior to the metal exiting the mold cavity as the starter block is advanced downwardly, and a cooling fluid is introduced to the surface of the metal proximate the exit of the mold cavity as the metal is cast to draw heat from the cast metal ingot and to solidify the molten metal within the now-solidified shell of the ingot. As the starter block is advanced downward, the cooling fluid may be sprayed directly on the ingot to cool the surface and to draw heat from within the core of the ingot.

FIG. 1 depicts a general illustration of a cross-section of a direct chill casting mold 100 during the continuous casting process. The illustrated mold could be for a round billet or a substantially rectangular ingot, for example. The cooling water spray pattern as described herein is primarily directed to round billet casting. However, embodiments could potentially be used for a substantially rectangular ingot, particularly when the corners of said ingot have some degree of curvature. As shown, the continuous casting mold 105 forms a mold cavity from which the cast part 110 is formed. The casting process begins with the starter block 115 sealing or substantially filling the bottom of the mold cavity against mold walls of the continuous casting mold 105. As the platform 120 moves down along arrow 145 into a casting pit and the cast part begins to solidify at its edges within the mold walls of the continuous casting mold 105, the cast part 110 exits the mold cavity. Metal flows from pouring trough 125, which may be a heated reservoir or a reservoir fed from a furnace, for example, through spout 130 into the mold cavity. As shown, the spout 130 is partially submerged within a molten pool of metal 135 to avoid oxidation of metal that would occur if fed from above the molten metal pool 135. The solidified metal 140 constitutes the formed cast part, such as an ingot. Flow through the spout 130 may be controlled within the pouring trough 125, such as by a tapered plug fitting within an orifice connecting a cavity of the pouring trough 125 with a flow channel through the spout 130. Conventionally, the pouring trough 125, spout 130, and mold cavity/mold walls of the continuous casting mold 105 are held in a fixed relationship from the beginning of the casting operation through the end of the casting operation. Flow of metal through the spout 130 continues as the platform 120 continues to descend along arrow 145 into the casting pit. When the casting operation is to end, either by the platform being at the bottom of its travel, the metal supply running low, or the cast part reaching the completed size, the flow of metal through the spout 130 stops, and the spout assembled on the trough is removed from the molten pool of metal 135 to allow the molten pool to solidify and complete the cast part.

FIG. 2 illustrates an example embodiment of the direct chill casting process according to the present disclosure including a continuous casting mold 105, trough 125, and spout 130 for supplying molten metal from the trough to the cavity 107 of the mold. The illustrated embodiment of FIG. 2 includes a starting position where the tip of the spout 130 is positioned proximate the starter block 115 which is supported by the platform 120. The starter block 115 is positioned atop platform 120 and aligned to cooperate with the mold 105 to seal the mold cavity 107 and preclude molten metal from leaking from between the continuous casting mold 105 and the starter block 115.

FIG. 2 illustrates the start of a cast with the starter block 115 aligned with the mold continuous casting 105. As the cast starts shown in FIG. 3, the platform 120 descends with the starter block 115 as molten metal flows through the spout 130 from the trough 125, and solidifies on the starter block 115 and at the bottom of the mold cavity 107. In this manner, as the starter block 115 descends away from the continuous casting mold 105, the cast part, shown in FIG. 4 as 140, is formed. FIG. 4 illustrates the run-state phase of the casting process or the steady-state portion where the platform 120 descends at a near constant rate with the cast part 140 growing accordingly. FIG. 2 also illustrates spray jets 150 that will be described in greater detail below, where the spray jets provide a coolant or cooling fluid to the surface of the casting.

Of critical importance as the casting process is performed is the cooling of the billet or ingot. Conventionally, direct chill casting cooling was based upon a "water curtain" concept. This typically includes a continuous film or sheet of water surrounding the casting and provided relatively uniform cooling. However, there are several drawbacks. The water film of the water curtain requires s substantial amount of water to maintain the uniformity of the sheet of water. The velocity of the water film is typically relatively low such that efficient heat extraction is limited. Maintaining a truly equal amount of water flow around the entire periphery of the mold is difficult, and the continuous sheet of water prevents the escape of steam which can build up between the continuous sheet of water and contact with the casting. This steam could build in pressure and periodically release in bursts that may disrupt the continuous film of water.

The water curtain has generally been supplanted with a row of water spray holes that direct water to impinge on the surface of the billet. A variety of water hole concepts have been used, with the primary differences being the angle of attack or impingement upon the billet surface. However, the water hole concepts have exclusively focused on water directed straight toward the surface of the billet, toward a central axis of a cylindrical billet. The water hole direct chill cooling concept improved upon the water curtain cooling method for several reasons. The water had an increased velocity through the hoes which increased the efficiency of the cooling effect with lower overall water consumption. Gaps between water holes allowed any steam generation about the impingement point to easily escape. Water flow distribution about the mold periphery was also improved.

While there are benefits of a water jet over a water curtain, there are also shortcomings. It has been established that the more perpendicular the impact, or higher impingement angle of the water stream upon the hot billet surface, the higher the cooling rate. However, the higher the angle (more perpendicular to the surface of the billet), the water stream has a greater tendency to rebound off the surface of the billet, which has a negative effect on the overall cooling efficiency. This is particularly problematic when higher water flows (velocity) are required to compensate for high incoming water temperatures.

The Dualjet water pattern introduced by the Applicant includes two rows of water spray holes with alternating angles of impingement. The primary, or high impact angled holes provide highly efficient cooling. Though due to the high impact angle, the water jets have the tendency to bounce-off, even at lower flow rates. Secondary alternating holes have a lower impingement angle aimed at the water bouncing off of the billet surface, and re-directs the rebounded water together with the water from the secondary holes to the billet surface. This enables very high flow rates and efficient cooling with little water bouncing-off the surface. This Dualjet system provides enhanced cooling technology for improved cooling performance.

Figure 5A:
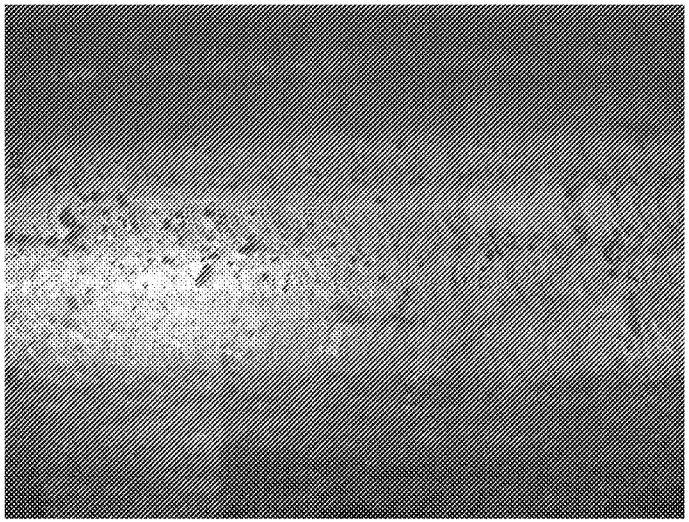

While the Dualjet is effective and efficient, Applicant has found an improved method of cooling and solidifying a billet. The alternating jet impingement pattern on the billet surface of the Dualjet may lend to cold spots and warmer areas between the jets. This may lead to a non-uniform solidification front on the surface of the billet. Certain alloys may experience surface cracks from hotter areas, where the shell of the casting is slightly weaker. Further, these warmer areas lend themselves more to casting surface attachments and light intermittent drags. The non-uniform cooling pattern may resemble a herringbone pattern that can be seen on the surface of some billets as shown in FIG. 5A.

Figure 5B:
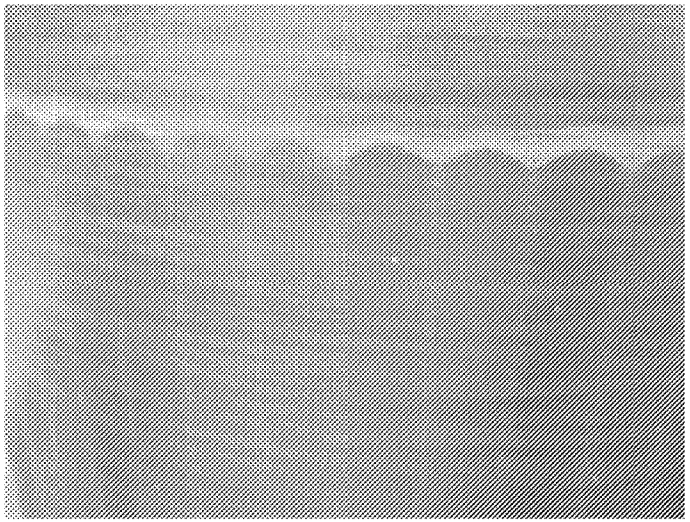
Figure 5C:
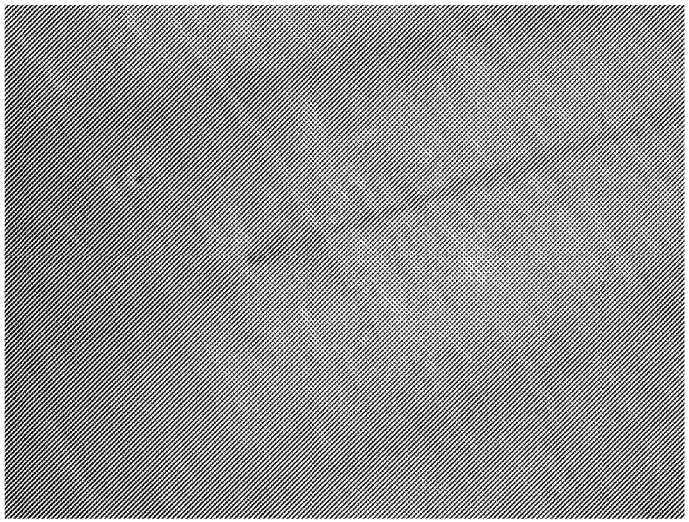

FIG. 5B illustrates hard water deposits on an as-cast billet surface due to the high heat of the solidifying aluminum. The 'scalloped' pattern may be an indication of the non-uniform cooling effect of the alternating jet spray pattern. The vertical streaks of FIG. 5C may be areas that were hotter where surface cracks and casting ring pick-up can occur.

While the Dualjet alternating jet design provides substantial improvements over earlier cooling attempts, embodiments provided herein use an improved water spray cooling pattern. The set of spray jets disclosed herein create a helical, spiral pattern of cooling fluid around a casting. A set of spray jets may include a plurality of water jets with a compound angle of impingement relative to the casting. While conventional cooling jet design includes a jet pointed toward a centerline of the casting extending down into the casting pit, and angled down into the casting pit by a predetermined angle, embodiments described herein include spray jets angled away from the centerline of the casting to a point closer to tangential to the casting. The spray jets may be angled within a range; however, the upper limit of such a range would have the water jet angled just below tangential to the casting, as a tangential spray may not contact the casting and may instead spray off into the casting pit providing no cooling effect. A spray jet angled less than tangential provides an angle of impingement on the casting whereby the Coandă effect occurs, as detailed further below.

FIG. 6C illustrates a simplified diagram of a top-view of a billet mold 170 with mold cavity 175 through which the billet is formed. A centerline 180 of the mold cavity 175 that corresponds to a centerline of a casting produced by the mold is also shown. A single spray jet 150 is show illustrative of one of a plurality of spray jets disposed about the mold. An example embodiment described herein may include any number of spray jets, and they may each be positioned at the same angle of impingement upon the casting around the billet mold 170. As shown, the spray jet 150 of FIG. 6C is positioned at an angle away from the centerline of the casting in a "perpendicular rotated angle" 160. FIG. 6D illustrates a simplified diagram of a side-view of a billet mold 170 with mold cavity 175 through which the billet is formed. As shown, the representative spray jet 150 is arranged with a vertical impingement angle 155 such that the representative spray jet is angled down into the casting pit as the casting exits the mold 170.

Figure 5D:
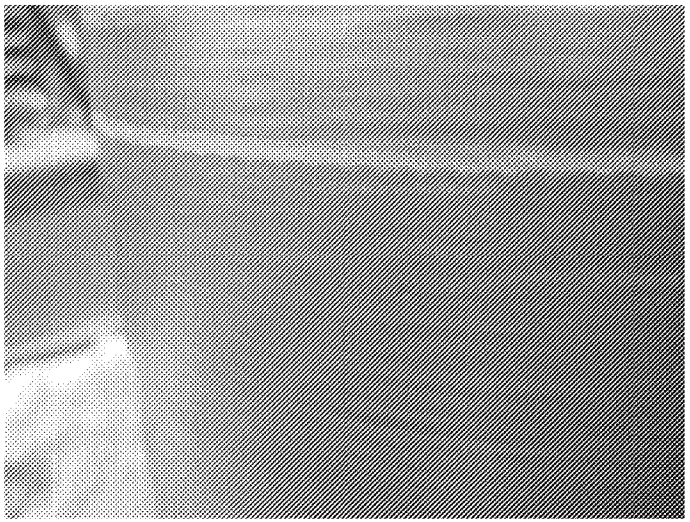

Embodiments described herein may include an angle of vertical impingement (angle 155 of FIG. 6D)—whereby the spray jet is angled down into the pit (rotating about the x-axis or y-axis as shown in the reference frame of FIG. 8) and a perpendicular-rotated angle (angle 160 of FIG. 6C) away from the central axis of the billet, with this angle rotating relative to the z-axis of FIG. 8. This perpendicular-rotated angle alters the angle of a spray jet between pointed at the central axis of the casting, and tangential to the casting. According to an example embodiment described herein, the vertical impingement angle may be between 30- and 60-degrees, or more preferably, between about 35 and 45 degrees, with an example embodiment described herein having around a 40-degree vertical impingement angle. Example embodiments may include a perpendicular-rotated angle of between about 20 and 45 degrees, and more preferably between about 25 and 35 degrees, with the example embodiment described herein having a 30-degree perpendicular-rotated angle—angled away from the central axis of a billet. This configuration results in a 'spiral' water pattern as seen in FIGS. 6A and 6B. A key advantage of the spiral water pattern is the improved uniformity of the solidification front on the surface of the billet. This phenomenon can be seen in the comparison of FIGS. 5B and 5D, where the indicator is the hard water deposit left on the billet surface. The vertical deposit lines are an indication that the area directly between impingement points of the Dualjet primary spray holes is substantially hotter than the water impact points. FIG. 5D shows very little evidence of these vertical stain lines, and the 'scalloped' or saw tooth effect of the spray impingement points are much less distinct, indicating an improvement in surface cooling uniformity over the Dualjet pattern.

As noted above, a single jet or single impingement water spray pattern is not new. However, the single jet impingement disclosed herein can employ substantially higher water flow rate or velocity than a spray jet pointed toward the central axis of a billet. In direct chill casting, the cooling water flow rate is influenced heavily by the incoming temperature of the cooling water. This temperature can be fairly high in many climates. As the water temperature increases, the water flow rate needs to increase to maintain proper solidification rates. Single jet water spray patterns are susceptible to 'bounce-off' of the water jets, which reduces the efficiency of the cooling effect. The Dualjet system was developed to allow for higher water flow rates while maintaining water contact to the billet surface.

According to embodiments described herein with a compound angle of the water jets, angled away from the center axis of the billet and thus not perpendicular to the billet but rather more tangential, the water jet produces a spiral action pattern and allows the cooling fluid or water to 'hug' the billet surface and wrap around the billet without bouncing off at higher water flow rates. FIG. 6B illustrates this advantage. This is due to a phenomenon known as the Coandă effect. The Coandă effect is the tendency of a fluid jet to stay attached to a convex surface. The Romanian inventor Henri Coandă described the phenomenon as "the tendency of a jet of fluid emerging from an orifice to follow an adjacent flat or curved surface and to entrain fluid from the surroundings so that a region of lower pressure develops." The Coandă effect or wall-attachment effect is the tendency of a moving fluid, either liquid or gas, to attach itself to a surface and flow along the surface. As a fluid moves across a surface, a certain amount of friction (skin friction) occurs between the fluid and the surface, which tends to slow the moving fluid. This resistance to the flow of the fluid pulls the fluid toward the surface, causing it to stick to the surface. Thus, a fluid emerging from a nozzle tends to follow a nearby curved surface, even to the point of bending around corners if the curvature of the surface or the angle the surface makes with the stream is not too sharp. FIG. 7 illustrates the Coandă effect.

As the definition of the Coandă effect outlines, the curvature of the impacted surface and the velocity of the stream are interrelated such that there is a critical angle at which the 'hugging' effect of the water no longer exists and the stream separates from the surface. For the application of the Coandă effect relative to the direct chill billet cooling, specific factors influence this critical angle.

The curvature of the billet surface is a function of the compound angles of the water jet impingement stream and the billet diameter itself. These compound angles are in the 'X-Y' and 'X-Z' planes relative to the billet, as shown in FIG. 8. Conventional direct chill water cooling spray jets impact the billet perpendicular to the surface and angled downward, such that the 'X' angle is 90 degrees and the 'Z' angle is 15-45 degrees. Rotating the 'X' angle provides the tangential element to the stream that allows the to take place. Manipulating the 'X' and 'Z' angles maintains the Coandă effect for differing billet diameters to keep the relative surface curvature below the critical angle by 'stretching' the spiral component of the pattern. This in effect relaxes the true radius of the billet.

Embodiments described herein may use a single row of spray jets disposed around the exit of the mold cavity; however, embodiments may optionally incorporate the Dualjet alternating spray jet pattern, whereby two or more rows of spray jets may be disposed around the exit of the mold cavity. In this manner, the spray jets in the two or more rows may be arranged at different angles in each row. The differing angles may be differing in both the vertical angle (down into the casting pit) and the horizontal angle (degree of tangentiality with respect to the casting). Such an embodiment may provide improved cooling efficiency. While two or more rows may aid with catching or deflecting "bounce off" water back toward the casting, embodiments using the spiral pattern water spray as disclosed herein are less susceptible to bounce off, and may further provide a degree of catching the bounce off by virtue of the angled streams of coolant being vertically layered in that water falling from a first coolant stream may be picked up by a stream below in the spiral, helical pattern.

According to another example embodiment described herein for aluminum direct chill casting, individual drilled water spray holes may be substituted with a 'corrugated' shaped ring as shown in FIGS. 9A and 9B, that when sandwiched between two pieces of the mold body, creates a spiral patter that more resembles a water sheet, similar to a water slot. The difference being that the velocity of the individual spray 'openings' is higher than a true water slot, increasing the cooling efficiency. The spiral pattern retains the advantage of higher flow rates without bounce-off due to the Coandă effect. The corrugated shape can be stamped with a die, rolled with a knurling tool, formed by additive manufacturing, or machined from solid material, for example. The corrugations of example embodiments could be channels of any shape based on the desired flow pattern. Corrugations could be rectangular, triangular, curved, or the like to provide a channel to accurately and repeatably steer the water flow in the desired pattern to the casting.

An advantage of embodiments described herein is the ability to easily replace the spray pattern as required. Drilled water spray holes may diminish in size over time due to a build-up of hard water deposits. Depending upon the water chemistry at a casting location, this build-up could be relatively slow, while in other locations the build-up may be very fast. Such build-up requires periodic removal from the spray holes to return the cooling performance of the mold to an as-new condition. This may be performed with drills sized according to the original hole diameter. However, this requires careful diligence of the mold technician not to cause irreparable damage by wallowing out the holes which can distort the water pattern.

The spiral cooling fluid pattern as described herein also provides another substantial advantage. When a mold position is plugged off from metal flow due to a bleed-out or other consequence (i.e., when the casing of the casting is not solidified as it exits the mold and the molten metal in the core of the casting pours out, shown in FIG. 11A), the head of the billet continues to descend along with other billets as the casting continues due to the casting process usually including multiple molds. With a conventional water spray with jets angled toward the center axis of the billet, at some point below the mold table, a converging water pattern results in a single, heavy stream of water that impacts the plugged off billet head and sprays sideways as shown in FIG. 11B, and impacts other surrounding billets. The force of this somewhat perpendicular deflected stream of water may be sufficient to bend one or more surrounding billets as shown in FIG. 11C. In some cases, the bend is substantial enough to scrap not only the plugged off billet, but one or more of the surrounding billets. The spiral water spray pattern spreads the water outwards as shown in FIG. 10A, thereby dissipating the water spray and does not generate a converged stream. While the outward water pattern may contact surrounding billets, the impact is much less forceful, the volume isn't concentrated in a single area, and the angle of impact is much less as compared to the semi-perpendicular deflection of a converged stream. This may preserve other castings from being deformed and scrapped.

While the above-described embodiments relate primarily to a round billet casting, embodiments may be used with rectangular or substantially rectangular ingots during casting. Such embodiments may include spray jets arranged as described above along each face of the rectangular ingot. While rounded corners may lead to a Coandă effect around the corners of the ingot, such an effect may not be necessary. Further, the spray jets may be arranged to extend beyond the width of a face of the ingot to ensure coverage of the face with the coolant from the angled spray jets. Such an embodiment would benefit from the angled cascade of coolant from the spray jets along each face thereby improving the cooling efficiency of the casting.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A direct chill casting mold comprising:

a mold body comprising two or more portions and defining a mold cavity there through; and a corrugated insert disposed between two of the two or more portions of the mold body, wherein the corrugated insert forms a plurality of spray jets arranged proximate an exit of the mold cavity, wherein the plurality of spray jets are angled with respect to the mold cavity such that streams of fluid exiting the plurality of spray jets impinge upon a casting exiting the mold cavity at an angle offset from a centerline of the casting.

2. The direct chill casting mold of claim 1, wherein the plurality of spray jets are arranged in a radial pattern around the exit of the mold cavity, and wherein the plurality of spray jets cooperate to provide a spiral of cooling fluid around the casting as it exits the mold cavity.

3. The direct chill casting mold of claim 2, wherein the plurality of spray jets are angled with respect to the mold cavity such that the streams of fluid exiting the plurality of spray jets experience the Coandă effect around a curvature of the casting exiting the mold cavity.

4. The direct chill casting mold of claim 1, wherein the angle offset from the centerline of the casting comprises a perpendicular rotated angle relative to the casting.

5. The direct chill casting mold of claim 4, wherein the perpendicular rotated angle comprises a vertical angle of between about 35 to 45 degrees from perpendicular to the casting.

6. The direct chill casting mold of claim 5, wherein the perpendicular rotated angle comprises a horizontal angle of between about 20 and 45 degrees from the centerline of the casting.

7. The direct chill casting mold of claim 1, wherein the angle offset from a centerline of the casting is less than an angle resulting in a stream of fluid tangential to the casting.

8. A method for direct chill casting comprising:

casting a billet from a direct chill casting mold cavity of a direct chill casting mold body having two or more portions and defining a mold cavity there through; and directing cooling fluid from a plurality of spray jets to impinge upon the casting exiting the mold cavity at an angle offset from a centerline of the casting;

wherein a corrugated insert disposed between two of the two or more portions of the mold body forms the plurality of spray jets.

9. The method of claim 8, wherein the plurality of spray jets are arranged in a radial pattern around an exit of the mold body, and wherein the plurality of spray jets cooperate to provide a spiral of cooling fluid around the casting as it exits the mold cavity.

10. The method of claim 9, wherein the plurality of spray jets are angled with respect to the mold cavity such that the streams of fluid exiting the spray jets experience the Coandă effect around a curvature of the casting exiting the mold cavity.

11. The method of claim 8, wherein the angle offset from the centerline of the casting comprises a perpendicular rotated angle relative to the casting.

12. The method of claim 11, wherein the perpendicular rotated angle comprises a vertical angle of between about 35 to 45 degrees from perpendicular to the casting.

13. The method of claim 12, wherein the perpendicular rotated angle comprises a horizontal angle of between about 20 and 45 degrees from the centerline of the casting.

14. The method of claim 8, wherein the angle offset from a centerline of the casting is less than an angle resulting in a stream of fluid tangential to the casting.

15. The direct chill casting mold of claim 1, wherein the corrugated insert comprises a plurality of corrugations corresponding to the plurality of spray jets, wherein the corrugations comprise a profile configured to direct the streams of fluid exiting the plurality of spray jets at the angle offset from the centerline of the casting.

16. The direct chill casting mold of claim 1, wherein the corrugated insert is sandwiched between the two of the two or more portions of the mold body, wherein the two of the two or more portions of the mold body together with the corrugated insert form fluid channels, wherein the fluid channels conduct the fluid around the mold cavity.

17. A direct chill casting mold comprising:

a first portion of a mold body;

a second portion of the mold body; and a corrugated insert sandwiched between the first portion and the second portion of the mold body in a fluid slot, wherein the corrugated insert is configured to cause fluid to exit the fluid slot in a spiral pattern.

18. The direct chill casting mold of claim 17, wherein the fluid exiting the fluid slot in the spiral pattern adheres to a surface of a casting exiting the direct chill casting mold body about at least a portion of a circumference of the surface.

* * * * *